US007475486B1

(12) United States Patent
Fitzgerald et al.

(10) Patent No.: US 7,475,486 B1
(45) Date of Patent: Jan. 13, 2009

(54) CREEP DETERMINATION TECHNIQUE

(75) Inventors: Peter Fitzgerald, Paris (FR); Torbjørn Tellnes, Bergen (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 43 days.

(21) Appl. No.: 11/842,464

(22) Filed: Aug. 21, 2007

(51) Int. Cl.
*E21B 47/00* (2006.01)

(52) U.S. Cl. ..... 33/302; 175/40

(58) Field of Classification Search ..... 33/302, 33/303; 73/152.54, 152.56; 175/40, 45
See application file for complete search history.

(56) References Cited

U.S. PATENT DOCUMENTS 4,625,795 A * 12/1986 Despax et al. ..... 166/66
5,033,307 A 7/1991 Uhri
5,062,048 A 10/1991 Coulter
5,351,531 A 10/1994 Kerr
5,590,714 A * 1/1997 Van Steenwyk et al. ..... 175/40
6,704,655 B2 3/2004 Kelly
6,766,869 B2 * 7/2004 Brand et al. ..... 175/45
2007/0187146 A1 * 8/2007 Wylie et al. ..... 175/45

* cited by examiner

*Primary Examiner*—G. Bradley Bennett
(74) *Attorney, Agent, or Firm*—Rodney Warfford; David Cate; Jaime Castano

(57) ABSTRACT

A method for determining an amount of creep for a tool on a cable and positioned in a well at an oilfield. The method includes moving a winch at a surface of the oilfield to effect movement of the tool below the surface in the well. The winch may then be stopped with the tool still in the well, but frequently the tool will continue to move, or "creep", for some time after the winch is stopped. After the winch is stopped, data may be recorded indicative of movement of the tool. This data may then be used for the determining of the amount of creep.

17 Claims, 5 Drawing Sheets

CREEP DETERMINATION TECHNIQUE

FIELD

Embodiments described relate to techniques for evaluating downhole conditions within a well at an oilfield. In particular, techniques are described that allow an estimate of the "creep" of a tool on a cable as it is run downhole in the well for an application.

BACKGROUND

Exploring, drilling and completing hydrocarbon and other wells are generally complicated, time consuming and ultimately very expensive endeavors. In recognition of these expenses added emphasis has been placed on well logging, profiling and monitoring of well conditions. Over the years, the detecting and monitoring of well conditions has become a more sophisticated and critical part of managing well operations.

Initial gathering of information relative to well and surrounding formation conditions may be obtained by running a logging tool in the well. Typically, a logging cable may be used to deliver the tool into the well by means of a winch at the surface of the oilfield. A device positioned near the winch at the oilfield surface records the amount of cable lowered into the borehole and thereby indicates the depth of the tool in the well. With the tool positioned downhole, the cable is then pulled uphole as the logging application proceeds. In this manner a log revealing an overall profile of the well may be established, with measurements being recorded continuously as a function of depth in the well.

For subsequent logging passes, perhaps containing different sensors, recorded measurements may be aligned with those of the above noted reference log previously acquired. That is, typically, the first log acquired in a well is considered the "reference", and all subsequent runs are adjusted in depth to match this reference. This process, referred to as "depth correlation" ensures that corresponding measurements from the same section of the formation that is penetrated by the well are seen to be coincident when the logs are compared. The various measurements from the disparate sensors may then be combined to produce a more complete interpretation of the nature of the formations traversed by the well.

On occasion, some logging tools may be run which, by their nature, are to be positioned accurately at a specified depth, and remain at that depth for an extended period of time while measurements or other operations are performed. Such operations may include the measurement of fluid properties in the formation, the taking of fluid or rock samples from the formation for later analysis at the surface, or even the perforation of the metallic casing commonly used to isolate the formation from the wellbore once the wellbore is completed. Regardless of the particular application, knowledge as to the actual depth of the tool may be of substantial importance.

Unfortunately, it is frequently observed that, as the winch is stopped as the tool is brought to the required station depth, the tool continues to move for some time. This effect is sometime referred to as "creep". As a result, the depth of the tool as determined with reference to the stopped winch at the surface fails to reflects the actual or true position of the tool downhole during the creep period. This, in turn, may lead to serious operational problems due to the lack of precise knowledge as to the location of the tool. For example, difficulty may arise in correlating data acquired with the tool in a stationary position with data recorded during the reference log with a moving tool. Similar difficulty may arise in correlating fluid or rock samples from the stationary tool with the dynamically acquired reference logging data. This may in turn result in the ultimate delivery of the tool to the wrong station or target depth within the well for the application to be performed.

SUMMARY

A method for determining an amount of creep for a tool on a cable and positioned in a well at an oilfield is disclosed. The method includes moving a winch at a surface of the oilfield to effect movement of the tool below the surface in the well. The winch may then be stopped with the tool still in the well. After the stopping, data may be recorded to detect movement of the tool. This data may then be used for the determining of the amount of creep.

DETAILED DESCRIPTION

Embodiments are described with reference to certain logging tools and applications within a well. As such, certain configurations of logging tools are described. However, a variety of configurations may be employed. Regardless, embodiments described may be employed for techniques that involve obtaining tool movement information directly from the tool itself as it is moved within the well. Additionally, the well is referred to herein as below an "oilfield". The term oilfield is meant to reference any geologic field from which hydrocarbon exploration or production may be sought. This may include land fields, sub-sea locations and others.

Figure 1:
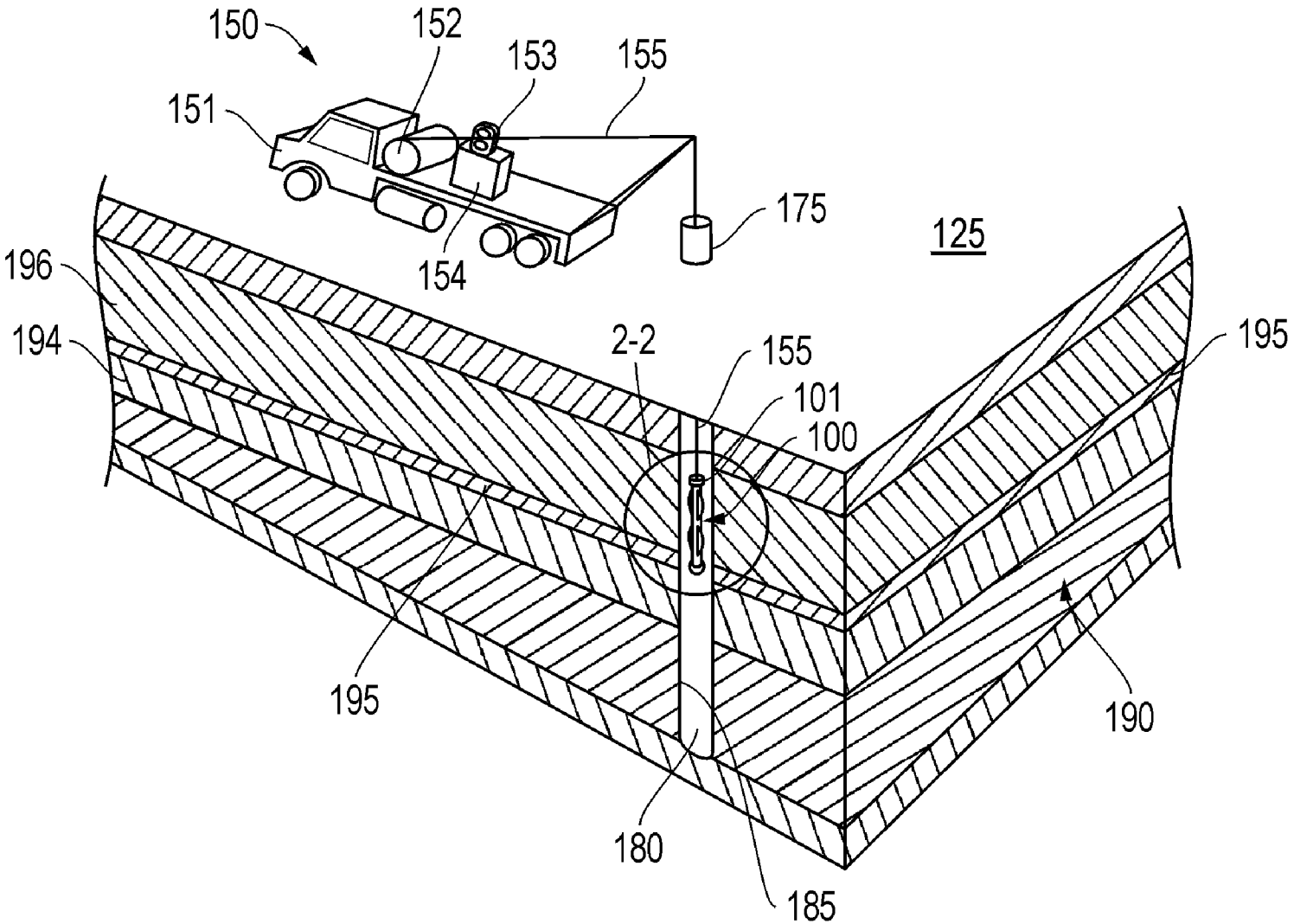
FIG. 1 is an overview of a logging application employing a movement detector equipped tool in a well at an oilfield that is coupled to a winch at the oilfield surface.

Referring now to FIG. 1 an overview of an oilfield 125 is shown where a tool 100 equipped with a movement detector 101 is positioned within a well 180 for a logging application. The movement detector 101 may consist of a device such as an odometer or speedometer that indicates tool displacement or velocity directly or an accelerometer whose data may be processed to derive tool velocity. The tool 100 is coupled to a cable 155 that is moved or displaced in order to affect the depth of the tool 100 in the well 180 by wireline equipment 150. In the embodiment shown, the wireline equipment 150 is provided to the oilfield 125 in a mobile manner with a wireline truck 151. The wireline truck 151 is outfitted with a winch 152 for supplying and directing the cable 155 for the application.

During a logging application, the above noted cable 155 may be run through a depth-measurement device 153. The depth-measurement device 153 may be employed to meter the amount of cable 155 that is supplied from the winch 152 into the well 180 through a wellhead 175 at the surface of the oilfield 125. As depicted, the depth-measurement device 153 may include a wheel assembly to physically track and meter cable 155 into and out of the well 180, providing such information to a control unit 154 where creep determination and other computations may be performed. That is, as described further below, the control unit 154 may be coupled to the depth-measurement device 153 as well as the winch 152 and cable 155 for obtaining and computing information retrieved therefrom. Metering information obtained by the depth-measurement device 153 in particular may be used to dynamically establish a winch depth and thus, speed or velocity at any given time throughout the logging application. As detailed further below, this information may be plotted against a tool velocity derived from the tool 100 downhole and analyzed by a processor of the control unit 154, for example to determine the amount of creep that may be experienced by the tool 100 during the application.

As indicated above, a tool velocity or speed may be determined during the logging application and employed to help determine the amount of creep that takes place during the application. As noted earlier, the creep is the amount of movement undergone by the tool 100 in the well even after the winch 152 has stopped. For example, the tool 100 may be pulled uphole by the winch 152 and cable 155 for a period of time and then the winch 152 stopped. However, due to a variety of factors, the tool 100 may continue to creep uphole. Therefore, the tool 100 is equipped with a movement detector 101 that may be employed to dynamically track tool movement. In this manner, tool speed or velocity information may be employed to determine the amount of creep occurring during the application as detailed further below.

In the embodiments shown herein, the movement detector 101 is a conventional accelerometer providing acceleration data from which the tool velocity may be determined. However in other embodiments the movement 101 detector may be a mechanical metering instrument, such as an odometer or speedometer, for contacting the well wall 185 either mechanically or with a sensor to provide the tool movement information directly. The velocity of the tool 100 may be measured with reference to fluid flow in the well 180 or by other methods.

As indicated above, tool movement information may be obtained during the operation by the movement detector 101. This movement information, along with a variety of other information collected by the tool 100, may be directed back to the control unit 154 through the cable 155. That is, the cable 155 may be a variety of line types with information carrying capacity. For example, the embodiment shown reveals a cable 155 in the form of a conventional wireline with capacity to deliver power to the tool 100. However, in alternate embodiments the cable 155 may be employed as a slickline, without power delivering capacity, perhaps employing an alternative tool type for non-logging applications.

Continuing with reference to FIG. 1, the cross-section of the oilfield 125 reveals that the formation 190 includes a variety of layers of different geophysical characteristics. For example, the layers may be interposed or alternating layers of shale and sand, such as the targeted sand layer 195 of the depicted embodiment that is sandwiched between a downhole shale layer 194 and an uphole shale layer 196. The targeted sand layer 195 may be no more than a few feet thick. However, information relative to the layer 195 may be of particular interest for a subsequent hydrocarbon production application. That is, this may be a zone from which hydrocarbons may be readily produced. Thus, associating the proper well information obtained by the tool 100 with the particular location of the targeted sand layer 195 may be of significant importance. Techniques described herein of accounting for creep of the tool 100 help to ensure that the proper well information is indeed associated with the proper well location.

Figure 2:
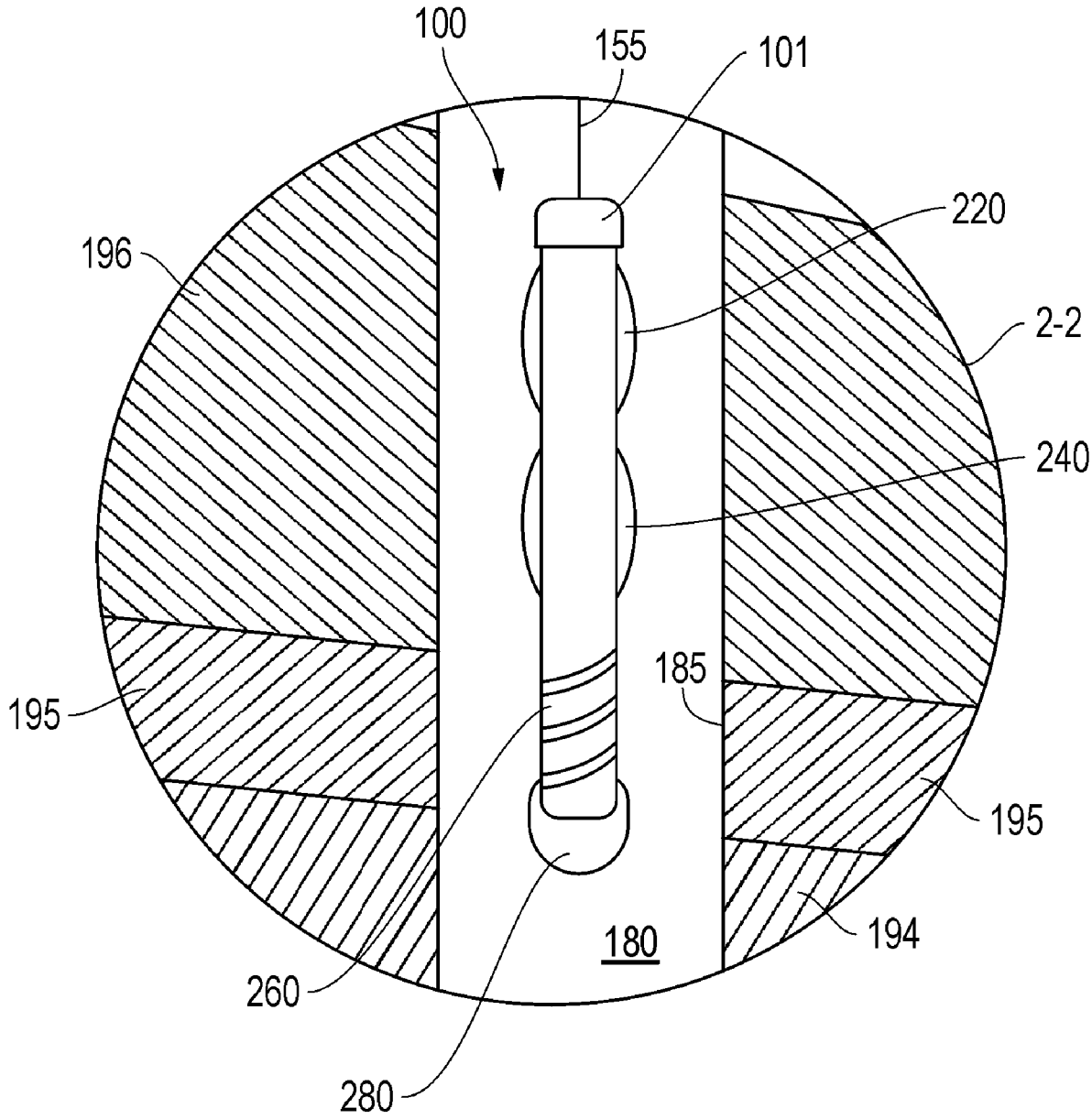
FIG. 2 is an enlarged view of the tool in the well and surrounding formation taken from 2-2 of FIG. 1.

Referring now to FIGS. 1 and 2, the capabilities of the tool 100 are described in greater detail. In particular the tool 100 is equipped with a movement detector 101 in the form of a conventional accelerometer to aid in the determination of tool movement such as creeping during an application as noted above. However, the tool 100 is also equipped with a variety of diagnostic implements for sampling conditions within the well 180. For example, a saturation implement 220 may be provided to obtain water flow information. An ejector implement 260 may be employed in conjunction with the saturation implement, for example by ejecting a non-radioactive marker for detection by the saturation implement 220 in establishing water flow information. Other diagnostic implements may include an imaging implement 240 as well as a fullbore spinner implement 280 to measure fluid velocity.

In addition to the implements 220, 240, 260, 280 noted above, a variety of other diagnostic implements may be accommodated by the tool 100 for establishing pressure, temperature, hydrocarbon states and other well conditions including surrounding formation data throughout the well. Indeed, in one embodiment the tool 100 is equipped with a retrieval mechanism for physically sampling portions of the well wall 185 to determine formation characteristics. For example, sampling the targeted sand layer 195 disposed between shale layers 194, 196 may be of particular benefit in the embodiment shown.

Figure 3A:
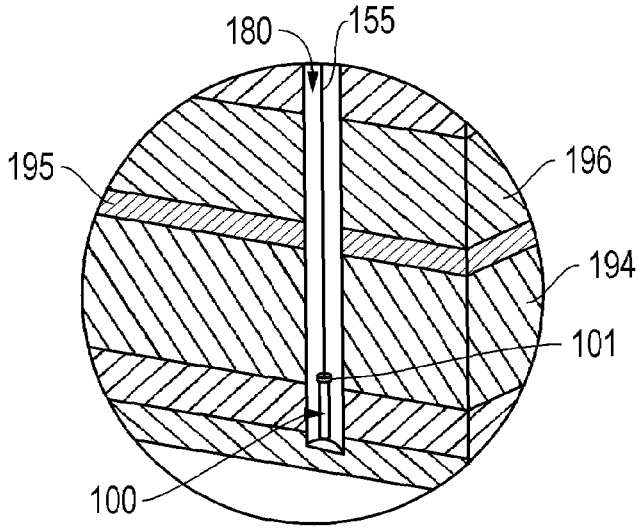
FIG. 3A is a depiction of the tool of FIGS. 1 and 2 positioned at a downhole location in a substantially idle state from which the winch may pull the tool uphole.
Figure 3B:
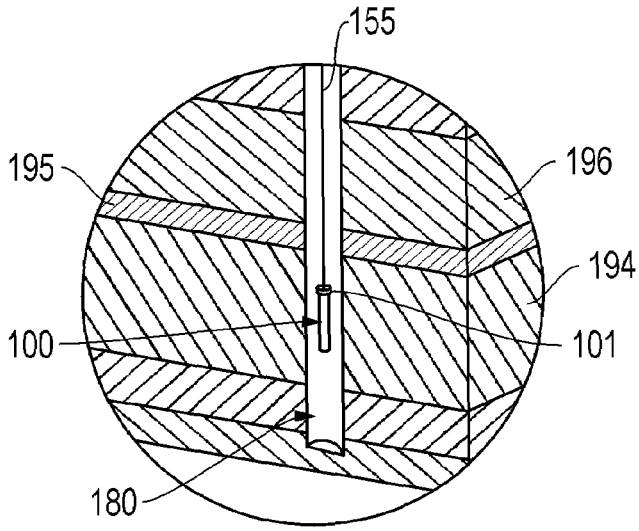
FIG. 3B is a depiction of the tool of FIG. 3A positioned at a winch-stop location uphole of the downhole location as the winch of FIG. 1 is stopped.
Figure 3C:
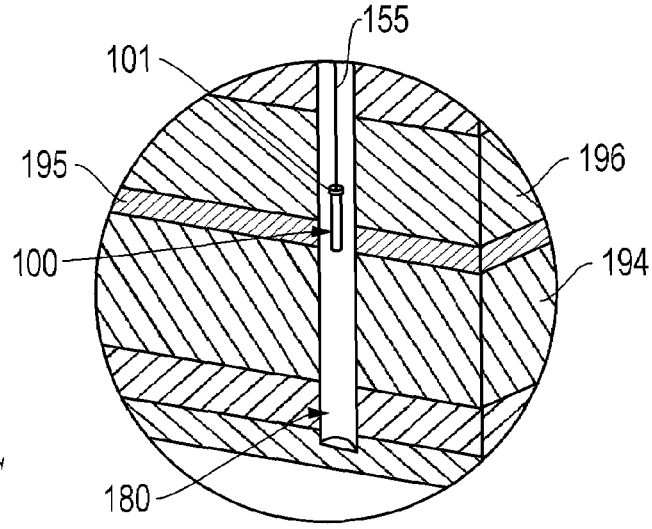
FIG. 3C is a depiction of the tool of FIG. 3B stopped at a tool-stop location and having an actual tool depth that is substantially that of a winch depth as measured at the surface.

Referring now to FIGS. 3A-3C, the tool 100 is shown moving from an initial downhole location at FIG. 3A to a winch-stop location at FIG. 3B and continuing on to a tool-stop location of FIG. 3C. As alluded to above, readings obtained from the movement detector 101 of the tool 100 during such a progression may be contrasted against information relative to movement of the winch 152 as measured at the surface (see FIG. 1). In this manner, the creep of the tool 100 from the winch-stop location of FIG. 3B to the tool-stop location of FIG. 3C may be monitored and accounted for. Thus, diagnostic readings retrieved by the tool 100 during such creeping are not mistakenly assigned to the targeted location of the sand layer 195 thereby resulting in an erroneous profiling of the well. Techniques for calculating the amount of creep in this manner are detailed further with respect to the chart of FIG. 4 and the particular example of 3A-3C, described below.

With particular reference to FIG. 3A, with added reference to FIG. 1, the tool 100 is shown at a downhole location below the position of the targeted sand layer 195 and other surrounding layers (e.g. the downhole shale layer 194). The tool 100 is suspended in this relatively idle state and may be assigned a depth in the well 180, referred to herein as a tool depth. At the downhole location of FIG. 3A, the actual tool depth is roughly equivalent to the depth as calculated at the surface of the oilfield 125, for example, by reference to the winch 152 and cable 155 at the cable monitor 153. This latter depth measured at the surface may be referred to herein as the winch depth. Thus, as depicted in FIG. 3A, the winch depth is roughly equivalent to the actual tool depth.

Continuing with reference to FIGS. 1 and 3B, the winch 152 is employed to pull the cable 155 and ultimately the tool 100 in an uphole direction away from the downhole location of FIG. 3A. At this time, the winch depth and tool depth may continue to match one another on average. However, as detailed below, and is apparent on the chart of FIG. 4, the rate of change in these depths may diverge.

During this initial period of movement of the tool 100 from the position of FIG. 3A to that of FIG. 3B, readings may be taken by the noted diagnostic implements 220, 240, 260, 280 of FIG. 2, pursuant to a conventional logging application. As the winch 152 winds up the cable 155 in this manner, it stands to reason that the above noted winch depth is reduced. Likewise, the uphole movement of the tool 100 reduces the actual tool depth. However, as indicated above, the rate at which the actual tool depth is reduced may differ from the rate of reduction in winch depth as measured at the surface of the oilfield 125. That is, the true uphole movement of the tool 100 may be a bit rough or erratic with stopping and slipping or with the cable 155 stretching and shrinking along the way. The winch depth, on the other hand may continue to be reduced fairly smoothly as the winch 152 winds up the cable 155 in an uninterrupted manner at the surface of the oilfield 125.

Figure 4:
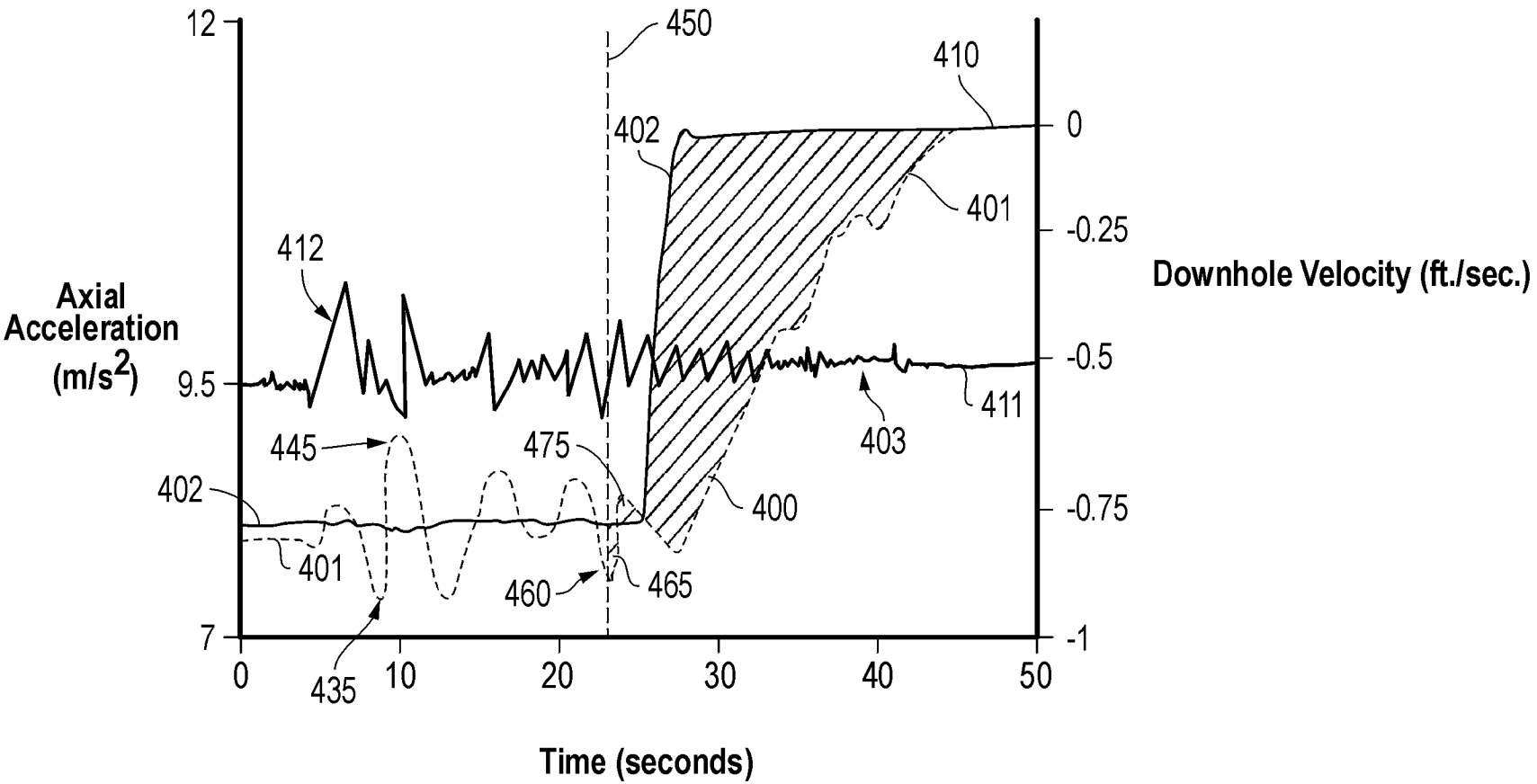
FIG. 4 is a depiction of the acceleration of the tool of FIGS. 3A-3B over a period of time, together with the computed velocity of the tool and the measured velocity of the cable at the oilfield surface.

In light of this potential discrepancy in tool depth versus winch depth, the tool 100 is outfitted with a movement detector 101 as indicated above. In this manner, true tool positioning information may be obtained in real-time similar to the winch 152 and cable 155 information obtained from the cable monitor 153 at the surface of the oilfield 125. This information may be plotted for comparative analysis as depicted in the chart of FIG. 4. Furthermore, this information may be particularly beneficial for determining creep as noted above and described further below.

Continuing now with reference to FIGS. 1, 3B and 3C, the winch 152 may be stopped at the surface with the tool 100 in a winch-stop location as depicted in FIG. 3B. Thus, the reduction in winch depth as measured at the surface of the oilfield 125 may cease. However, the tool 100 may continue to advance or "creep" uphole for a period as the cable 155 shrinks back to shape. For example, it is quite likely, due to viscous forces, that the cable 155 has been stretched out during the uphole advancement noted above. Thus, as the winch 152 is stopped, the cable 155 may shrink back to shape as the viscous forces break down and cease to affect tool positioning.

By monitoring the amount of creep that takes place between the winch-stop location of FIG. 3B and when the tool 100 comes to idle rest at the tool-stop location of FIG. 3C, an accurate profile of condition information relative to this portion of the well 180 may be determined. In fact, the creep may be predetermined through test runs or prior employment of the application. In such an embodiment, the winch 152 may be stopped at the winch-stop location of FIG. 3B with the measured winch depth indicating a depth roughly equivalent to that of a targeted area of interest such as the layer of sand 195 described above. The tool 100 may then continue to creep toward the targeted tool-stop location of FIG. 3C at the predetermined rate and amount and be accounted for in real time profiling of this area of the well 180. Techniques for calculating the amount of creep in this manner are detailed further with respect to the chart of FIG. 4, described below.

Referring now to FIG. 4, with added reference to FIGS. 1-3C, a chart depicting the movement of the tool 100 versus that of the winch 152 is shown. The acceleration of the tool along the borehole axis ("axial acceleration") is plotted versus time as a curve of axial acceleration 412. The winch velocity is also plotted versus time as a curve of winch velocity 402. Additionally, a curve of tool velocity 401 is depicted which is computed as a function of time.

For the first 25 seconds or so of the example data set shown in FIG. 4, the tool velocity 401 is seen to be roughly the same as the winch velocity 402. The imperfect match between the two velocities 401, 402 may be due to conditions in the well 125 resulting in intermittent variations in friction, further causing the cable 155 to stretch or shrink in an apparently random fashion. For example, at point 435 the velocity of the tool 100 is greater than that of the winch 152 whereas at point 445 the tool 100 is moving uphole more slowly than the cable 155 as computed at the winch 152. This may be a result of changing forces and hence changing stretch of the cable 155. However, on average the tool velocity matches the winch or cable velocity as determined by measurements made by the movement detector 101 of the tool 100 and the depth-measurement device 153 at the winch 152. Therefore, the tool depth may be correlated to the winch depth as described above.

For the period noted above, the areas of above noted valleys (e.g. valley 435) below the winch velocity 402, will tend to be roughly equivalent to the areas of the above noted peaks (e.g. peak 445) above the winch velocity 402 as indicated. This is because these areas represent the divergence of tool and winch depths with depth being a displacement (i.e. the integral versus time of velocity). Thus, the divergence of the two depths over a reasonable period of time may be treated as zero.

Continuing with reference to FIGS. 3B, 3C and FIG. 4, with added reference to FIG. 1, the winch 152 is stopped at about 26 seconds and the winch velocity 402 rapidly reaches a value of zero (see the feet/second reference axis at the right of the chart). Notice that in the chart of FIG. 4, the sign convention is such that a positive velocity corresponds to a movement towards greater depth, and a negative velocity towards a shallower depth. Once the winch velocity 402 reaches zero as indicated, it remains stably there from about 28 seconds through the end of the depicted period of about 50 seconds. However, at this same time the tool 100 is moving from the winch-stop location of FIG. 3B to the tool-stop location of FIG. 3C in the form of creep as detailed above. This is apparent with reference to the tool velocity 401, derived in this case from the axial acceleration 412 by integration versus time (following a correction for the removal of the gravitational component). The area 400 between the winch velocity 402 and the tool velocity 401 from a given point in time (e.g. 450) until both velocities 401, 402 are stable at a value of zero is a graphical representation of the total amount of tool creep from that time until the tool finally becomes stationary.

As referenced herein, the amount of "creep" is the divergence of the tool depth from the winch depth from a time when the two are known to be equal until a time when both the winch 152 and tool 100 are known to be stationary. Graphically, this "creep" may be represented primarily by the depicted area 400 of FIG. 4. That is, as shown in FIG. 4, the area 400 presents from the time of winch stop at about 25 seconds and persists until the tool depth and winch depths are identical (i.e. when the tool 100 ultimately reaches the tool-stop location of FIG. 3C).

Additionally, the creep area 400 may be adjusted with reference to a selected point in time 450 which may be plotted corresponding to the centroid of a velocity valley 460. In such an embodiment, the velocity valley 460 may be the last valley in tool velocity 401 below winch velocity 402 which precedes the creep area 400 and returns to at least the winch velocity 402 prior thereto. It stands to reason that at some point between this plotted point in time 450 and winch-stop, the stretch of the cable 155 would be at equilibrium. Thus, a period for which cable equilibrium presents closest to the time of winch-stop may be examined more closely. That is, with reference to a vertical axis of this plotted point in time 450, the winch and tool velocities 401, 402 cross immediately thereafter as the tool 100 slows down. To the extent that stretching and shrinking of the cable occurs after the plotted point in time 450, valley area 465 below the winch velocity 402 may be added to the creep area 400 whereas peak areas 475 may be subtracted therefrom as a matter of adjusting the calculated amount of creep.

Figure 5:
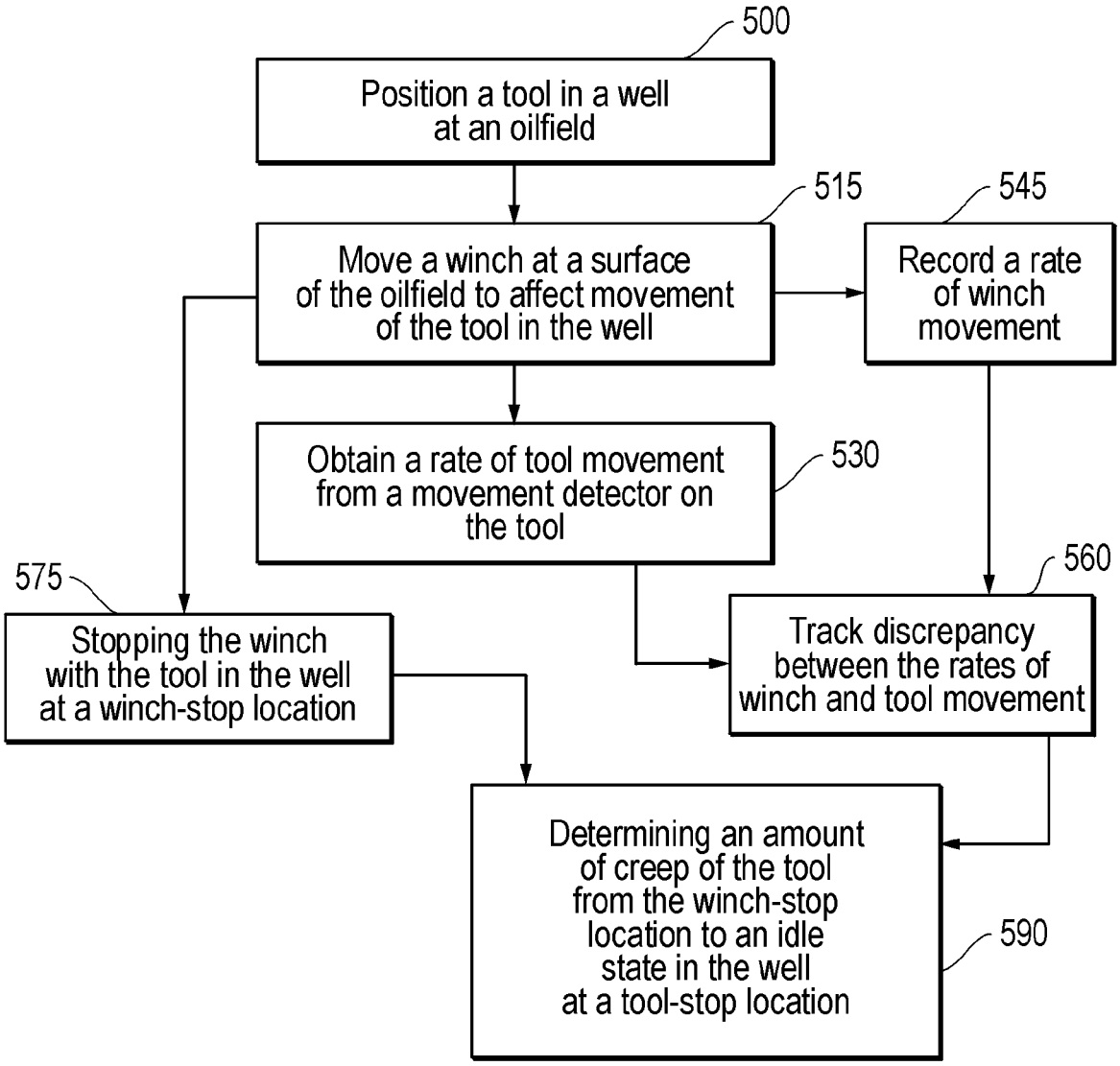
FIG. 5 is a flow-chart summarizing embodiments of evaluating tool movement from the downhole location to the tool-stop location.

Referring now to FIG. 5, a flow-chart is depicted summarizing embodiments of evaluating tool movement from the downhole location to the tool-stop location. Of note is the fact that such embodiments are realized in part by the inclusion of a movement detector on the tool rather than sole reliance on movement information obtained from other locations. That is, with reference to 500 and 515, once the tool is positioned in a well at an oilfield and movement effectuated by the winch at the surface of the oilfield, a rate of tool movement, or tool velocity, may be obtained from the movement detector on the tool as indicated at 530. Such a measurement may be obtained directly using a device sensitive to the velocity of the tool with respect to the well or fluid in the well (a "speedometer"), or be derived from a measurement of displacement, for example using measurement wheel pressed against the formation or an imaging device performing correlation of one measurement with another spaced a known distance apart (an "odometer") or acceleration (an "accelerometer").

Additionally, the rate of winch movement, or winch velocity, may be recorded at the winch as indicated at 545. Thus, discrepancies between the winch rate and tool rate may be tracked as indicated at 560. This may be of particular benefit when the winch is stopped as indicated at 575 followed by an expected significant amount of creeping of the tool. As indicated at 590, the noted discrepancies from a time at which the winch depth and tool depth are deemed to be equal may be used to determine the amount of such creeping of the tool.

Techniques have been described hereinabove for evaluating tool movement from an initial downhole location to a final tool-stop location during an application. Discrepancies between the rates of winch and tool movement are overcome in part by employment of a movement detector directly at the tool. Thus, knowing where the tool is precisely positioned during an application may be ascertained with greater ease. This may be of particular benefit in light of the significant amount of creeping of the tool which generally occurs in a logging application without any measurable movement of the winch upon which to rely. Furthermore, embodiments described hereinabove are achieved without reliance upon the insertion of gamma ray sources or other downhole detectable features generally unavailable for use in many wells such as those of an open-hole configuration.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A method of determining an amount of creep for a tool on a cable positioned in a well at an oilfield, the method comprising:

moving a winch at a surface of the oilfield to effect movement of the tool below the surface in the well;

stopping the winch with the tool in the well;

detecting movement of the tool after said stopping with a movement detector on the tool; and employing data from said detecting for the determining.

2. The method of claim 1 wherein the data includes a tool velocity, the method further comprising:

recording a winch velocity during said moving; and plotting the tool velocity versus the winch velocity, said employing further comprising calculating an area between plotted tool velocity and plotted winch velocity after said stopping as the amount of creep.

3. The method of claim 2 further comprising adjusting the calculated amount of creep by examination of area between the plotted tool velocity and the plotted winch velocity immediately adjacent and preceding said stopping.

4. A method comprising:

positioning a tool at an initial downhole location in a well at an oilfield;

moving a winch at a surface of the oilfield to effect movement of the tool in the well;

detecting the movement of the tool with a movement detector on the tool;

stopping the winch with the tool at a winch-stop location in the well; and recording continued movement of the tool from the winch-stop location to a substantially idle state at a tool-stop location in the well as an amount of creep for an application.

5. The method of claim 4 further comprising determining an actual tool depth for the tool in the well from said detecting.

6. The method of claim 4 wherein said moving occurs at a winch velocity and the movement occurs at a tool velocity, the method further comprising recording the winch velocity versus the tool velocity during an application.

7. The method of claim 6 further comprising tracking discrepancy between the winch velocity and the tool velocity during the application.

8. The method of claim 4 wherein said recording occurs at a processor of a control unit coupled to the winch and in communication with the movement detector.

9. The method of claim 4 further comprising:

obtaining well condition information; and establishing an adjusted well profile including the well condition information in a manner accounting for the amount of creep.

10. The method of claim 9 wherein said obtaining comprises sampling a portion of a wall of the well with the tool at the tool-stop location.

11. A diagnostic tool for positioning in a well at an oilfield and comprising:

a diagnostic implement for sampling a condition in the well; and a movement detector to detect movement of the tool in the well by a winch at a surface of the oilfield, the winch coupled to the tool via a cable.

12. The diagnostic tool of claim 11 wherein said movement detector is one of an accelerometer to permit computation of tool velocity, a metering instrument to track velocity, and a device to measure displacement directly.

13. A diagnostic assembly for establishing a profile of a well at an oilfield, the assembly comprising:

a winch for positioning at a surface of the oilfield;

a cable having a first end secured to said winch; and a tool for positioning in the well and coupled to a second end of said cable, said tool having a movement detector for detecting movement of the tool in the well effectuated by said winch.

14. The diagnostic assembly of claim 13 wherein said cable is one of wireline and slickline.

15. The diagnostic assembly of claim 13 further comprising:

a wireline truck to accommodate said winch;

a control unit at said wireline truck and coupled to said winch for communication therewith; and a cable monitor coupled to said control unit for providing cable metering information thereto.

16. The diagnostic assembly of claim 15 further comprising a processor of said control unit for obtaining information from the detecting for calculating an actual depth of the tool in the well.

17. The diagnostic assembly of claim 16 wherein said processor is programmed for estimating an amount of creep of the tool by examination of a change in the actual depth when said winch is in an idle state.

* * * * *